US005433801A

United States Patent [19]

Althaus et al.

[11] Patent Number: 5,433,801

[45] Date of Patent: * Jul. 18, 1995

[54] RAZOR BLADE STEEL HAVING HIGH CORROSION RESISTANCE, RAZOR BLADES AND A PROCESS FOR MANUFACTURING RAZOR BLADES

[76] Inventors: Wolfgang Althaus, Hülsberg 94, D-5600 Wuppertal 12, Germany; Atsushi Kumagai, Nishimachi Co-op 205, 116-4, Nishimachi, Yonago-City, Tottori, Japan

[ * ] Notice: The portion of the term of this patent subsequent to Jan. 4, 2011 has been disclaimed.

[21] Appl. No.: 138,486

[22] Filed: Oct. 15, 1993

Related U.S. Application Data

[63] Continuation of Ser. No. 669,120, Mar. 12, 1991, Pat. No. 5,275,672.

[30] Foreign Application Priority Data

Nov. 10, 1990 [EP] European Pat. Off. ..... 90121538

[51] Int. Cl.[6] ..... C21D 6/04; C22C 38/22

[52] U.S. Cl. ..... 148/578; 148/607; 148/608; 148/325; 148/326; 420/34; 420/67

[58] Field of Search ..... 148/325, 326, 578, 605, 148/607-608; 420/67, 71, 34

[56] References Cited

U.S. PATENT DOCUMENTS 3,575,737 4/1971 Carlen ..... 148/325
4,180,420 12/1979 Sastri et al. ..... 148/325

FOREIGN PATENT DOCUMENTS 1279482 6/1972 United Kingdom ..... 420/67

*Primary Examiner*—Scott Kastler
*Assistant Examiner*—Sikyin Ip
*Attorney, Agent, or Firm*—Robert W. Becker & Associates

[57] ABSTRACT

Steel which is particularly useful for making a razor blade of high corrosion resistance contains more than 0.45%, but less than 0.55%, of carbon, 0.4 to 1.0% of silicon, 0.5 to 1.0% of manganese, 12 to 14% of chromium and 1.0 to 1.6% of molybdenum, all by weight, in addition to iron and inevitable impurities, and has a carbide density of 100 to 150 particles per 100 square microns as annealed. The razor blade has a Vickers hardness of at least 620 and a carbide density of 10 to 45 particles per 100 square microns, and preferably has a specific distribution of residual austenite content. The improved properties of the razor blade are achieved by an improved process of heat treatment which includes austenitizing the steel at a temperature of 1075° C. to 1120° C., cooling it to a temperature between −60° C. and −80° C. for hardening it, and tempering it at a temperature of 250° C. to 400° C.

7 Claims, 5 Drawing Sheets

HV1 - % RA

HV1

State of art

Invention

RAZOR BLADE STEEL HAVING HIGH CORROSION RESISTANCE, RAZOR BLADES AND A PROCESS FOR MANUFACTURING RAZOR BLADES

This is a continuation division, of application Ser. No. 699,120 filed Mar. 12, 1991, U.S. Pat. No. 5,275,672.

BACKGROUND OF THE INVENTION

1. Field of the Invention

This invention relates to Cr—Mo stainless steel used for making razor blades and showing a high resistance to corrosion, to razor blades, and also to a process for manufacturing razor blades.

2. Description of the Prior Art

High carbon steel containing 1.2% by weight of carbon and 0.4% by weight of chromium was usually used for making razor blades. This material showed a high degree of hardness when heat treated and could make a blade having a high level of cutting quality, but had the drawback of being poorly resistant to corrosion and of rusting easily.

Every razor is normally used in a more or less humid environment. When it is used, it is brought into contact with corrosive substances, such as the constituents of sweat, soap, and a shaving foam. Moreover, the nature of water which is used for shaving, and the temperature of the place where the razor is used, are likely to promote the rusting of its blade. The high carbon steel razor blade was primarily intended for providing a high level of cutting quality, and did not usually withstand any repeated use under the conditions as hereinabove stated.

Therefore, 13 Cr martensitic stainless steel has come to be used widely as a rust-resisting material for making a razor blade having a high level of cutting quality. Martensitic stainless steel containing 0.6 to 0.7% of carbon and 12 to 13% of chromium, both by weight, is used more often for making razor blades than any other stainless steel. This material has a hardness of, say, HV 620 to 650 when heat treated, and is superior to high carbon steel in rusting and corrosion resistance owing to the 13% Cr which it contains.

This material is, however, not completely free from the problem of rusting, either; when it is used for making razor blades, it is usual practice to form a coating of e.g. platinum, chromium or chromium nitride (CrN) on the surface of the material by sputtering to improve its corrosion resistance. Although the coating does certainly improve the corrosion resistance of the material, a razor blade made of this material still has an undesirably short life due to the corrosion which occurs at the grain boundary, and the rust which forms between the coating and the substrate. Moreover, the formation of the coating requires additional equipment and incurs an additional cost.

DE-OS 1 533 380 discloses low carbon stainless steel as a razor blade material having corrosion resistance. This steel contains 0.32 to 0.44% of carbon, 11 to 16% of chromium, 0.2 to 0.5% of silicon and 0.2 to 0.5% of manganese, the balance of the composition being iron. It contains at least 75% of martensite and has a Vickers hardness (HV) of at least 500 (as tested under a load of 0.5 kg), if it is austenitized at a temperature between 1080° C. and 1135° C., hardened by cooling to a temperature between −25° C. and −50° C., and tempered. This material is intended for making a bladeforming band for a "band" razor. The band razor has a magazine for holding a band in the form of a roll from which the band can be unwound little by little to supply a part defining a new blade each time it has been unwound. Although this low carbon and high chromium steel may be satisfactorily resistant to corrosion and be sufficiently tough to be wound into a roll, its hardness as heat treated is too low to enable the manufacture of a blade having a high level of cutting quality.

SUMMARY OF THE INVENTION

Under these circumstances, it is an object of this invention to provide a material for razor blades which shows a sufficiently high degree of hardness when heat treated, and has a sufficiently high degree of corrosion resistance without the need for any rustproofing surface treatment.

It is another object of this invention to provide a razor blade having a high degree of corrosion resistance, as well as a high level of cutting quality.

It is still another object of this invention to provide a process for easily and economically manufacturing a razor blade having a high degree of corrosion resistance and a high level of cutting quality.

According to a first aspect of this invention, there is provided a highly corrosion-resistant steel for making razor blades which contains more than 0.45% and less than 0.55% of carbon, 0.4 to 1.0% of silicon, 0.5 to 1.0% of manganese, 12 to 14% of chromium and 1.0 to 1.6% of molybdenum, all by weight, the balance of the steel being iron and inevitable impurities, and has a carbide density as annealed of 100 to 150 particles per 100 square microns.

The steel preferably contains more than 0.48% and less than 0.52% of carbon, 0.45 to 0.60% of silicon, 0.70 to 0.85% Of manganese, 13 to 14% of chromium and 1.15 to 1,45% of molybdenum, all by weight.

According to a second aspect of this invention, there is provided a highly corrosion-resistant razor blade formed from a material containing more than 0.45% end less than 0.55% of carbon, 0.4 to 1.0% of silicon, 0.5 to 1.0% of manganese, 12 to 14% of chromium and 1.0 to 1.6% of molybdenum, all by weight, the balance of the material being iron and inevitable impurities, and having a Vickers hardness of at least 620 and a carbide density of 10 to 45 particles per 100 square microns in the finished razor blade.

The blade preferably has at least a part of its surface coated with a layer of polytetrafluoroethylene (PTFE) or silicone. The blade preferably has a residual austenite content which is so controlled as to range between 24 and 32% at its surface, decrease gradually from its surface to the center of its cross section, and range between 6 and 14% at a depth of 50 microns below its surface. The controlled residual austenite content of the blade ensures the corrosion resistance of its surface and also the sharpness of its cutting edge, as the decrease in austenite enables uniform grinding.

According to a third aspect of this invention, + here is provided a process for making a highly corrosion-resistant razor blade which comprises austenitizing at a temperature of 1075° C. to 1120° C. continuously a strip of steel containing more than 0.45% and less than 0.55% of carbon, 0.4 to 1.0% of silicon, 0.5 to 1.0% of manganese, 12 to 14% of chromium and 1.2 to 1.6% of molybdenum, all by weight, the balance of the steel being iron and inevitable impurities, and having a carbide density as annealed of 100 to 150 particles per 100 square microns; cooling the strip to a temperature between −60° C. and −80° C. for hardening it; and tempering it at a temperature of 250° C. to 400° C., so that it may have a Vickers hardness of at least 620.

The steel of this invention is at least comparable in hardness as heat treated to the steel which contains 0.6 to 0.7% of carbon and 12 to 13% of chromium and is commonly used for making razor blades, and is by far superior in corrosion resistance. It enables the economical manufacture of razor blades, as it no longer requires any rustproofing surface treatment.

The process of this invention no longer includes any particular surface treatment of the nature which has hitherto been employed for improving the corrosion resistance of the blade. In other words, the razor blade of this invention is free from any coating of e.g. chromium or platinum that has often given rise to problems, such as the corrosion which occurs between the coating and the steel, and the dull edge which the coating gives to the blade. Therefore, the razor blade of this invention has a long life and a sharp cutting edge which ensures a high level of cutting quality.

The steel of this invention has a lower carbon content than the conventionally available steel, and is, therefore, easier to punch, grind and otherwise work for making razor blades.

Other features and advantages of this invention will become apparent from the following description and the accompanying drawings.

DETAILED DESCRIPTION OF THE INVENTION

Figure 1:
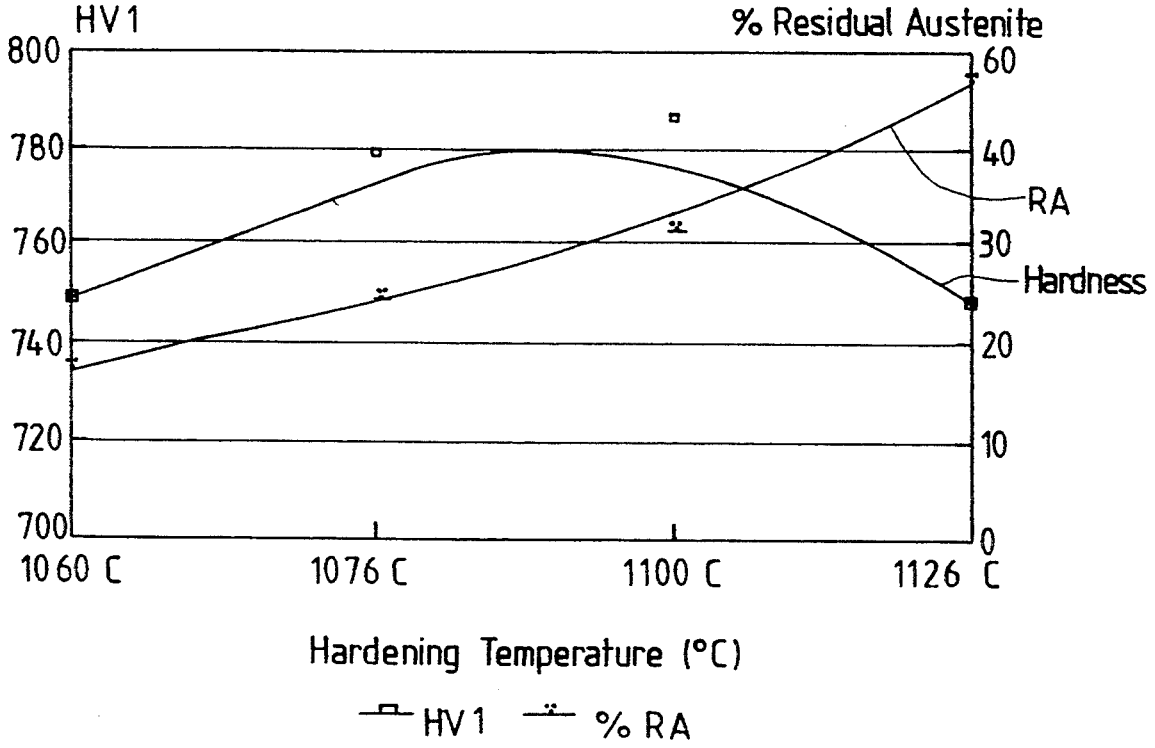
FIG. 1 is a drawing showing the temperature employed for hardening the steel of this invention, its hardness as hardened, and its residual austenite content.

The steel of this invention contains more than 0.45 to less than 0.55% of carbon, 0.4 to 1.0% of silicon, 0.5 to 1.0% of manganese, 12 to 14% of chromium and 1.0 to 1.6% of molybdenum, all by weight, the balance of the material being iron and inevitable impurities.

Carbon is an element which is important for the hardness of steel as heat treated, but lowers its corrosion resistance as its proportion increases. We have looked into the optimum proportion of carbon that ensures that the steel have a Vickers hardness of at least 620 when hardened and tempered, as measured under a load of 0.5 kg, while also taking the proportions of the other elements (mainly chromium ) into consideration. As a result, the presence of more than 0.45% of carbon has been found essential from the standpoint of hardness as set forth above. The presence of 0.55% or more of carbon has, however, been found to lower the corrosion resistance of steel and necessitate such surface treatment for making up its lower corrosion resistance as has been given to the presently available steel containing 0.65% of carbon and 13% of chromium. Therefore, the steel of this invention contains more than 0.45%, but less than 0.55%, of carbon. According to a salient feature of the steel of this invention, it has an improved corrosion resistance owing to its carbon content which is lower than that of the presently available stainless steel, and nevertheless, a satisfactorily high level of hardness as heat treated owing to its specific carbide density, as will hereinafter be described.

Silicon is usually added to molten steel as a deoxidizing agent. It is also useful for restraining the precipitation of carbide from steel and its softening when it is tempered at a low temperature.

A razor blade is usually coated with a resin, such as polytetrafluoroethylene (PTFE) or silicon, after a cutting edge has been formed on it, so that it may be smooth to the skin, and on that occasion, it is heated at a temperature of 350° C. to 400° C. Silicon is the most, effective element for restraining any reduction that occurs to the hardness of steel when it is heated when a resin coating is formed. In this connection, the presence of at least 0.4% of silicon is essential to ensure that the steel maintain a Vickers hardness of at least 620.

Silicon, however, forms a solid solution in steel, and thereby embrittles it and lowers its cold workability. It also forms hard non-metallic inclusions, such as $SiO_2$. The addition of too much silicon is, therefore, likely to make the formation of a proper cutting edge difficult, or result in an edge which is easily broken. Under these circumstances, the addition of more than 1.0% of silicon has been found undesirable. Therefore, the steel of this invention contains 0.4 to 1.0% of silicon.

Manganese is also used as a deoxidizing agent. It exists in the form of a solid solution in steel, and also forms manganese sulfide and manganese silicate as non-metallic inclusions. The hard inclusions formed by silicon must be removed from the steel, as they remain unchanged even by a strong force applied for cold working the steel, and eventually disable the formation of a proper cutting edge on a razor blade and also have an adverse effect on its properties. On the other hand, manganese sulfide and manganese silicate hardly present any problem in the formation of a razor blade or from the standpoint of its properties, since they are sufficiently soft to be deformable into a very small thickness by cold working.

It, therefore, follows that any and all unavoidable non-metallic inclusions need be fixed in the form of soft ones, such as those formed by manganese. At least 0.5% of manganese is necessary to form manganese sulfide. At least 0.5% of manganese is necessary to form manganese silicate when the proportion of silicon as hereinabove defined is taken into consideration. The addition of too much manganese must, however, be avoided, as it lowers the hot workability of steel. Therefore, the steel of this invention contains 0.5 to 1.0% of manganese.

Chromium is one of the most important elements for the rusting and corrosion resistance of steel. At least 12% of chromium is necessary to form a sufficiently passive film to render the steel of this invention resistant to corrosion. The use of too much chromium must, however, be avoided, since its formation of carbide at the temperature employed for austenitizing steel brings about a reduction in the carbon content of the steel and thereby in its hardness as heat treated. The hardness which the steel of this invention is required to exhibit when heat treated can be attained only when it contains not more than 14% of chromium. Therefore, the steel of this invention contains 12 to 14% of chromium.

Molybdenum is employed as the most effective element for preventing any pitting that halogen (particularly chlorine) ions would otherwise cause by destroying a passive film. The correlation which has been experimentally found to exist between the amount of molybdenum which is added, and the potential at which such corrosion can be prevented, teaches that it is necessary to add at least 1.0% of molybdenum in order to ensure that its addition be markedly effective. The addition of molybdenum provides another advantage, too. Steel containing molybdenum can be hardened at a higher temperature to achieve its maximum hardness as hardened than one not containing molybdenum can, since molybdenum forms a solid solution in chromium carbide and restrains the formation of a solid solution of carbide at the temperature at which steel is austenitized. The use of too much molybdenum, however, results in the hardening of carbide and the strengthening of the solid solution in the steel, which lowers its hot workability. Under these circumstances, the optimum upper limit of the molybdenum content of the steel according to this invention has been set at 1.6%. Thus, the steel of this invention contains 1.0 to 1.6% of molybdenum.

The chemical composition of steel which has been described is, however, not the only factor that dictates its hardness as heat treated. There is another factor having a critical bearing on its hardness. It is the microstructure of steel as annealed.

The hardness which steel acquires when hardened depends on the amount of carbide which is formed in a solid solution at the austenitizing temperature. If only too small an amount of carbide is formed, the insufficiency of carbon in the steel prevents it from being hardened to a satisfactorily high hardness. If too large an amount of carbide is formed, an increase of residual austenite prevents the hardening of steel to a high hardness. Insofar as the carbides which are formed in the steel of this invention are of the formula $M_{23}C_8$, where M is Cr, Fe or Mo, the formation of too small an amount of carbide can also mean an insufficiency of chromium which renders the steel unsatisfactorily resistant to corrosion.

Thus, the formation of an adequate amount of carbide, which is neither too large nor too small, is essential for the production of steel having both a high corrosion resistance and a satisfactorily high hardness when hardened. It is, moreover, necessary that the formation of an adequate amount of carbide in a solid solution take place within a short period of time, since a strip of steel which is used for making razor blades is hardened in a continuous furnace.

The analysis of factors which may play an important role in satisfying those requirements has revealed that the carbide density of steel as annealed is the most important factor. If steel has a carbide density which is as low as less than 100 particles per 100 square microns, the carbide particles are too coarse to undergo any satisfactory reaction to form a solid solution, resulting in the failure of steel to obtain any desired hardness. If steel has a carbide density which is as high as over 150 particles per 100 square microns, the carbide particles are so large as to form an excessively large amount of solid solution. This can bring about various problems including a reduction in hardness of steel due to an increase of residual austenite, the coarsening of crystal grains, and the development of strain by excessive expansion due to a non-uniform solid-solution or martensitic transformation.

Therefore, the steel of this invention has a carbide density of 100 to 150 particles per 100 square microns as annealed, which has been found as the optimum range for producing a strip of steel having a Vickers hardness of 620 to 670, and a satisfactorily high degree of corrosion resistance, when hardened and tempered in a continuous furnace. The optimum range of carbide density can be achieved by an appropriate control of the cold rolling and annealing conditions. More specifically, it can be achieved by an appropriate control of the heating rate and temperature which are employed for annealing. For example, it is sufficient to heat steel containing a complete solid solution of carbide, which has been formed during the hot rolling of steel, to a temperature of 800° C. to 840° C. at a heating rate of at least 15° C. per hour in a continuous annealing furnace and hold it at that temperature for an appropriate length of time, whereafter it is allowed to cool in the furnace.

The razor blade of this invention is manufactured by heat treating a strip of steel having the specific composition as hereinabove described, and a carbide density of 100 to 150 particles per square microns as annealed. The steel is first austenitized at a temperature of 1075° C. to 1120° C. This temperature range makes it possible to avoid the excess of carbide not forming a solid solution, and the coarsening of crystal grains. The austenitized material is immediately cooled in air, and is then subjected to subzero cooling at a temperature between −60° C. and −80° C. This subzero cooling is important for the decomposition of residual austenite and thereby ensures that the steel has a satisfactorily high hardness as hardened. Then, the steel is tempered at a temperature of 250° C. to 400° C. to attain a Vickers hardness of at least 620. If the tempering temperature is lower then 250° C., the steel is not tough enough, and if it exceeds 400° C., the steel can hardly attain a Vickers hardness of at least 620. The material which has been quenched and tempered has a carbide density of 10 to 45 particles per 100 square microns, which ensures that it have both a Vickers hardness of at lest 620 and a high degree of corrosion resistance.

Reference is made to the drawings illustrating the hardness and structural features of the steel and razor blade material according to this invention. FIG. 1 shows the hardness (HV) which the steel of this invention exhibited when hardened, and its residual austenite content (%) in relation to the austenitizing temperature. As is obvious therefrom, the steel hardened at a typical austenitizing temperature of 1090° C. has a Vickers hardness which is as high as about 780 and its residual austenite content is below 30%. The steel having such a high hardness when hardened gives a final product having a Vickers hardness of at least 620, or even at least 640 when the steel has been hardened at the austenitizing temperature of 1090° C., as is obvious from FIG. 2. These levels of hardness are sufficiently high to ensure the high cutting quality of the razor blade according to this invention.

Figure 3:
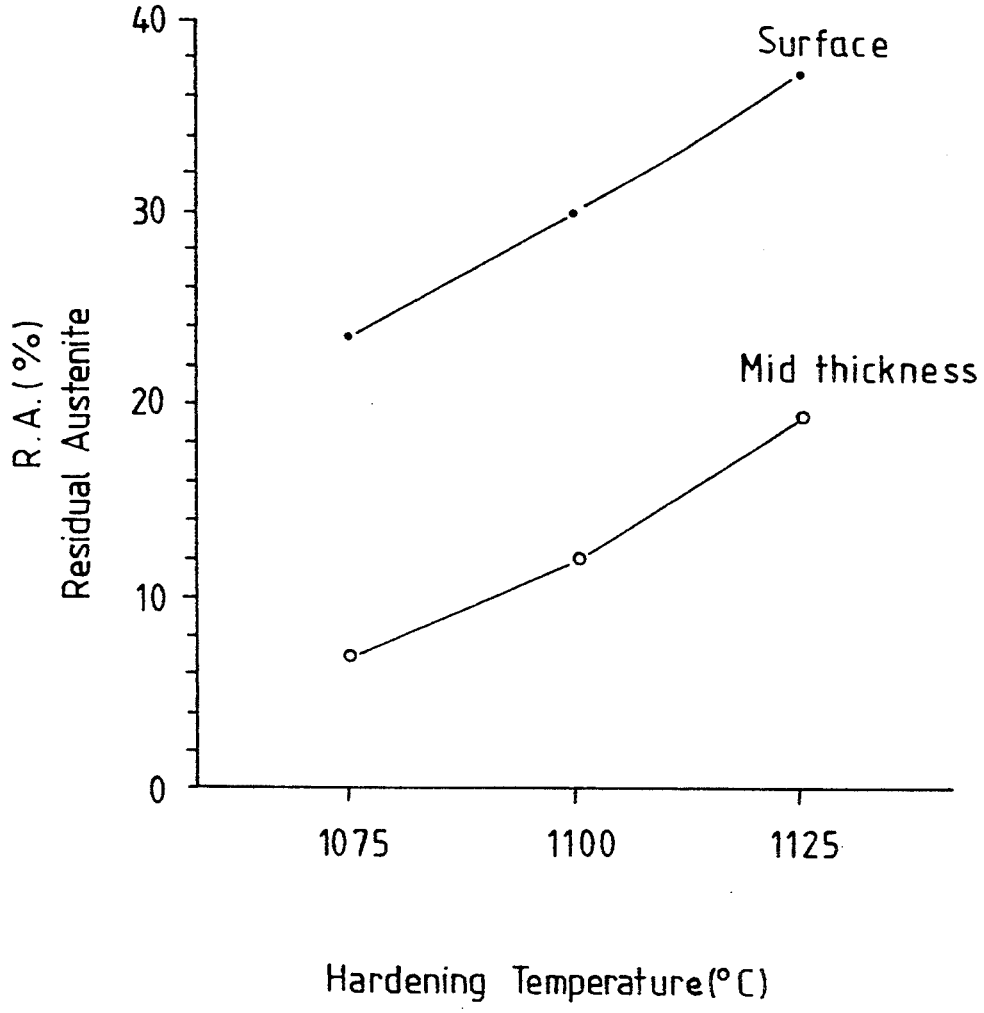
FIG. 3 is a drawing showing the amount of residual austenite varying along the thickness of a razor blade.

The process of this invention makes it possible to achieve a substantial difference in the amount of residual austenite between the surfaces of a strip of steel and its internal region having a depth of 50 microns below its surfaces (which region is equally distant from the opposite surfaces of a razor blade having a thickness of 0.1 mm and defines its cutting edge when it is ground), as is obvious from FIG. 3. The surfaces of the strip contain a large amount of residual austenite which adds to the corrosion resistance of a razor blade, while its central portion, as viewed across its thickness, has a low residual austenite content which ensures its uniform grindability to form a sufficiently hard cutting edge. The high corrosion resistance of the razor blade surfaces will be obvious from the results of salt spray and shaving tests which will hereinafter be described.

More specifically, the razor blade of this invention has a residual austenite content of 24 to 32% at its surfaces, and of 6 to 14% at a depth of 50 microns below its surfaces to which its cutting edge is defined.

The razor blade is preferably coated with a layer of polytetrafluoroethylene (PTFE) or silicon which reduces friction and renders the blade smoother to the skin. This coating is baked and its baking is usually carried out by heating at a temperate of about 350° C. to 400° C. Although this is generally a level of temperature at which steel is tempered and lowers its hardness, the razor blade of this invention is not appreciably affected by the heat applied for baking such coating, and does not, therefore, show any appreciable reduction in hardness when the coating is baked.

The invention will now be described in further detail with reference to more specific examples.

EXAMPLES

Steels of different chemical compositions were prepared, and are shown in Table 1. In Table 1, A to E are each steel embodying this invention, while F is a typical steel which is presently used for making razor blades, and known as 0.67 C-13Cr steel.

The raw materials for making each steel were melted in an electric arc furnace and the molten steel was formed into an ingot. The ingot was hot rolled into a billet, and the billet was hot rolled into a strip having a thickness of 1.0 to 2.0 mm, whereby carbide was completely converted to a solid solution. The strip was annealed and cold rolled repeatedly to yield a strip having a thickness of 0.1 min.

TABLE 1

| Steel | Chemical composition (wt %) C | Si | Mn | Cr | Mo | Fe | Remarks |
|---|---|---|---|---|---|---|---|
| A | 0.41 | 0.45 | 0.52 | 12.5 | 1.32 | Bal. | Steel of this Invention |
| B | 0.45 | 0.51 | 0.73 | 13.2 | 1.41 | Bal. | Steel of this Invention |
| C | 0.50 | 0.49 | 0.80 | 13.6 | 1.55 | Bal. | Steel of this Invention |
| D | 0.54 | 0.55 | 0.75 | 13.5 | 1.30 | Bal. | Steel of this Invention |
| E | 0.51 | 0.72 | 0.90 | 13.8 | 1.12 | Bal. | Steel of this Invention |
| F | 0.67 | 0.31 | 0.71 | 13.5 | — | Bal. | Conventional Steel |

Three samples of strip having different carbide densities were produced from each of steels A to F by employing an appropriate combination of continuous and batch annealing and varying the ratio of cold reduction. These samples were prepared for evaluation of hardness and corrosion resistance.

Each sample was heat treated under the conditions simulating those employed for making razor blades in accordance with this invention. The heat treatment consisted of 40 seconds of hardening at 1100° C. followed by air cooling, 10 minutes of subzero cooling at −78° C., and 30 minutes of tempering at 350° C. The sample as heat treated was examined for hardness. A salt spray test was conducted for evaluating each sample for corrosion resistance. The results are shown in Table 2.

The three samples prepared from each of steels A to F and having different carbide densities are shown as Samples Nos 1 to 3 in Table 2. Although all of steels A to E fall within the scope of this invention as far as the chemical composition is concerned, it is only Sample No. 2 that falls within the scope of this invention when the carbide density of steel as annealed is also taken into consideration. Sample No. 2 has a carbide density as annealed which falls within the range of 100 to 150 particles per 100 square microns, while Samples Nos. 1 and 3 do not, and are, therefore, designated as comparative. Sample No. 2 of conventional steel F also has a carbide density as annealed which falls within the range specified for the steel of this invention. Sample F'-2 is equal to F-2 in chemical composition and carbide density as annealed, but differs from it as having a surface layer of chromium formed by sputtering.

| Steel | Sample No. | Carbide density as annealed (particles/100 $\mu m^2$) | *Hardness as heat treated (HV) | Number or rust spots found after salt spray test | Number of rust spots found after shaving test | Remarks |
|---|---|---|---|---|---|---|
| A | 1 | 65 | 562 | 0 | — | Comparative |
| | 2 | 109 | 622 | 0 | 0 | Invention |
| | 3 | 160 | 613 | 0 | — | Comparative |
| B | 1 | 75 | 589 | 2 | — | Comparative |
| | 2 | 115 | 637 | 0 | 0 | Invention |
| | 3 | 157 | 615 | 0 | — | Comparative |
| C | 1 | 77 | 606 | 2 | — | Comparative |
| | 2 | 130 | 640 | 0 | 0 | Invention |
| | 3 | 189 | 618 | 0 | — | Comparative |
| D | 1 | 85 | 611 | 3 | — | Comparative |
| | 2 | 145 | 645 | 0 | 0 | Invention |
| | 3 | 193 | 615 | 1 | — | Comparative |
| E | 1 | 68 | 615 | 1 | — | Comparative |
| | 2 | 112 | 658 | 0 | 0 | Invention |

-continued

| Steel | Sample No. | Carbide density as annealed (particles/100 $\mu m^2$) | *Hardness as heat treated (HV) | Number or rust spots found after salt spray test | Number of rust spots found after shaving test | Remarks |
|---|---|---|---|---|---|---|
| | 3 | 165 | 618 | 2 | — | Comparative |
| F | 1 | 63 | 605 | 47 | — | Comparative |
| | 2 | 137 | 650 | 40 | 8 | Comparative |
| | 3 | 263 | 621 | 42 | — | Comparative |
| **F' | 2 | 137 | 650 | 27 | 4 | Conventional |

*Conditions of heat treatment:
Hardening 1100° C. × 40 sec, followed by air cooling
subzero cooling −78° C. × 10 min.
Tempering 350° C. × 30 min.
**F'-2 is equal to F-2, except that it further includes a layer of chromium formed by sputtering.

As is obvious from the results shown by every Sample No. 2, a Vickers hardness falling within the range of 620 to 670 can be attained only by steel having a carbide density as annealed which falls within the range of at least 100 particles per 100 square microns. It is also noted that the steel of this invention exhibits a satisfactorily high hardness when heat treated, owing to its appropriately controlled carbide density as annealed, though its carbon content is lower than that of the conventional steel. Steel having too high of a carbide density as annealed (see each Sample No. 3) exhibits an undesirably low hardness when heat treated, as a result of the stabilization of residual austenite by the excessive formation of a solid solution.

The salt spray test was conducted by leaving each heat-treated sample measuring 50 mm square in a spray of a 5% aqueous solution of sodium chloride having a temperature of 30° C. for three hours. The number of rust spots found, if any, on each sample was counted as a measure of its corrosion resistance. The results shown in Table 2 confirm the extreme superiority in corrosion resistance of the steel of this invention to the conventional steel F-2, as no or substantially no rust spot was found on any sample according to this invention. Sample No. F'-2 having a surface layer of chromium formed by sputtering was found to improve considerably the corrosion resistance of Sample No. F-2 not having any such layer, but its improved corrosion resistance was still very far from what was exhibited by any sample of this invention. The comparative samples deviating from the scope of this invention in their carbide density as annealed were also of good corrosion resistance, but as already stated, the hardness which they had exhibited when heat treated was too low for any razor blade having a high level of cutting quality.

Samples A-2, B-2, C-2, D-2 and E-2 of this invention and Samples F-2 and F'-2 of the conventional steel were each heat treated under the following conditions for making double-edged razor blades:

Conditions of heat treatment:
Austenitizing temperature: 1090° C.
Holding time for austenitizing: 40 sec.
Subzero cooling temperature: −70° C.
Temperature for baking a PTFE coating after preliminary tempering: 350° C.

Each razor blade was used for a shaving test. The test was continued for a week during which every razor blade was used every day. The test results are shown in Table 2. Eight rust spots were found at or near the cutting edges of the razor blade which had been made of Sample F-2, and four rust spots on the razor blade made of Sample F'-2 having a surface layer of chromium formed by sputtering. On the other hand, no rust spot whatsoever was found at the exposed cutting edge of any razor blade made of the steel according to this invention, nor was any corrosion found on the other cutting edge normally contacting a blade holder, despite the fact that no rustproofing surface treatment had been given to any razor blade according to this invention.

The use of the steel according to this invention enables the economical manufacture of razor blades by a simplified process which no longer includes any passivation, or any rustproofing oil treatment. The razor blade of this invention does not require any surface treatment for forming a coating of chromium chromium-platinum, chromium nitride, etc. protecting its cutting edge. The corrosion which is likely to occur between any such coating and the substrate has hitherto been a serious problem. Moreover, the coating, which usually has a thickness of 100 to 500 Å, has often been likely to deprive the cutting edge of its sharpness. The razor blade of this invention not having any such coating has a sharp edge and exhibits a high level of cutting quality.

Figure 2:
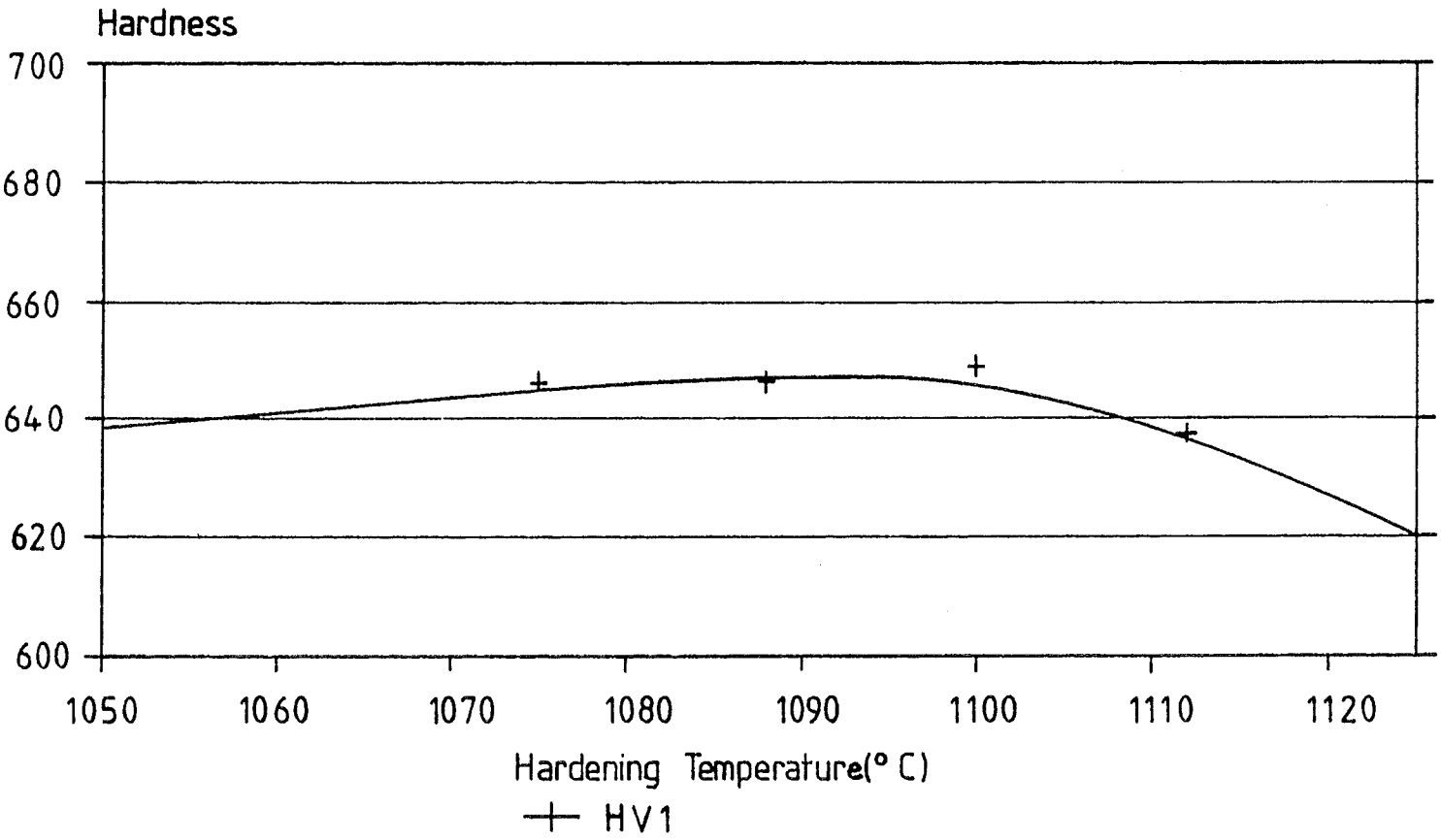
FIG. 2 is a drawing showing the temperature employed for austenitizing steel C-2 embodying this invention, and its hardness as tempered.

FIG. 2 shows the hardness of Sample C-2 as tempered at 350° C. in relation to the hardening (austenitizing) temperature. As is obvious therefrom, it showed a Vickers hardness of at least 620 even after it had been tempered at 350° C. These results confirm that the razor blade of this invention maintains a Vickers hardness of at least 620 even after its surface treatment with e.g. PTFE, and has, therefore, a high level of cutting quality and a long life.

Figure 4A:
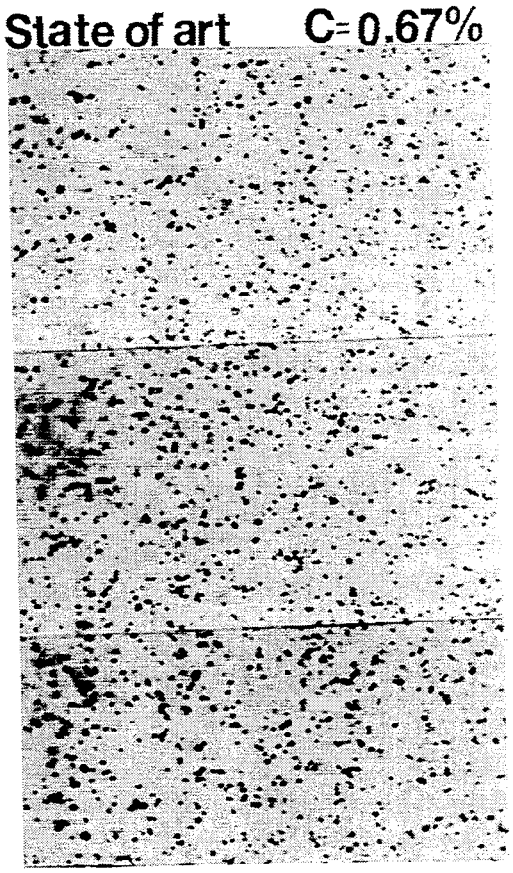
FIG. 4*a* is a photograph taken through an electron microscope at 1000 magnification and shows the carbide distribution in conventional steel F-2 as annealed.
Figure 4B:
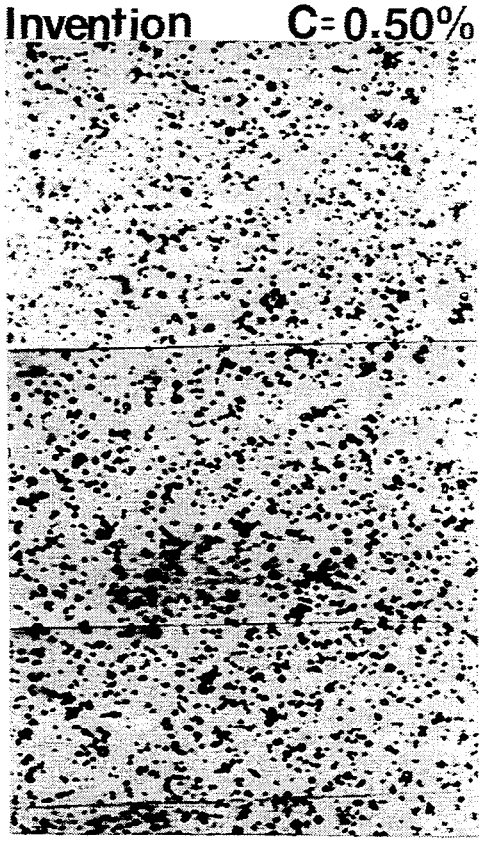
FIG. 4*b* is a photograph taken through and electron microscope at 1000 magnification and shows the carbide distribution in steel C-2 embodying this invention as annealed.
Figure 5A:
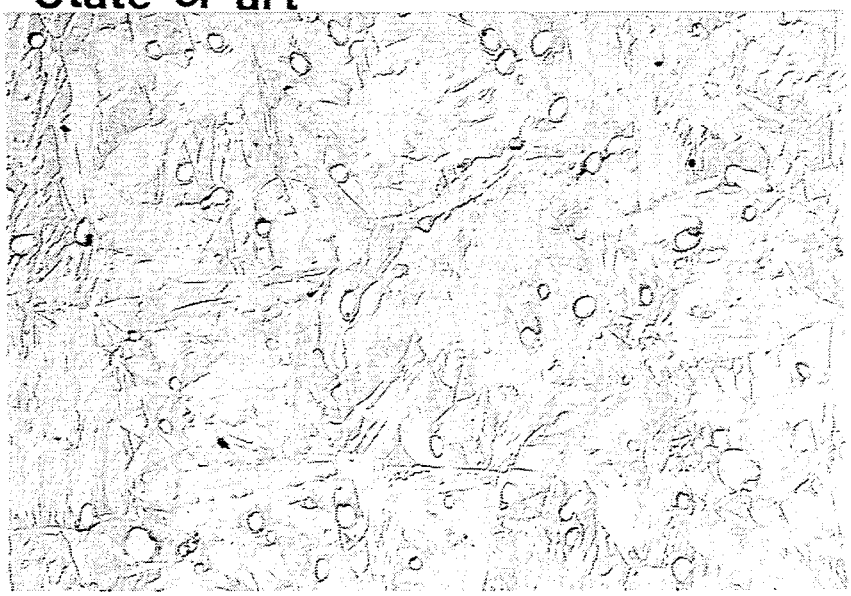
FIG. 5*a* is a photograph taken through an electron microscope at 4000 magnification and shows the microstructure of the cutting edge of a razor blade manufactured from conventional steel F-2.
Figure 5B:
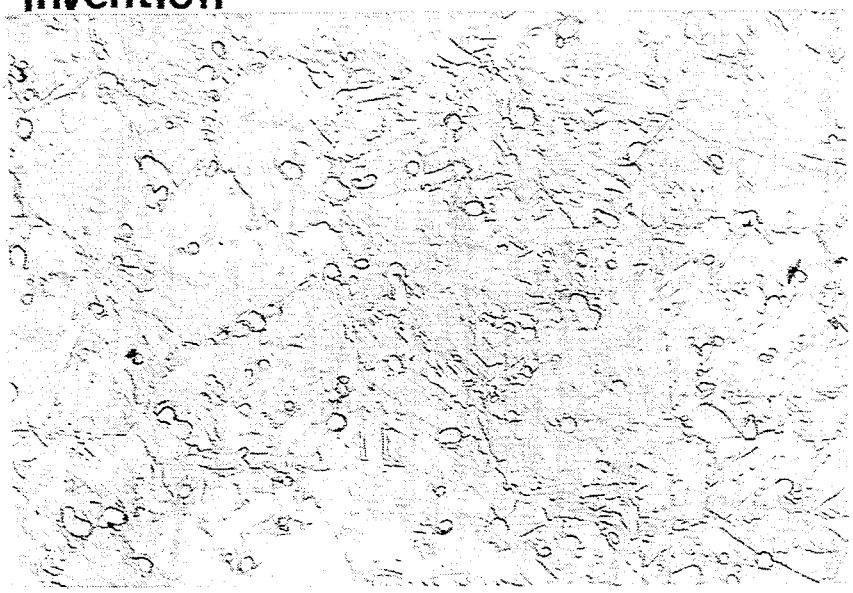
FIG. 5*b* is a photograph taken through an electron microscope at 1000 magnification and shows the microstructure of the cutting edge of a razor blade manufactured from steel C-2 embodying this invention.

FIGS. 4*a* and 4*b* are photomicrographs showing at a magnification of 1000 the carbide distributions in conventional steel F-2 (0.67% C) and steel C-2 embodying this invention (0.50% C), as annealed. FIGS. 5*a* and 5*b* are photomicrographs showing at a magnification of 4000 the structures of the cutting edges of razor blades manufactured from the same steels, i.e. F-2 and C-2, respectively. The razor blade made of the steel embodying this invention contains 16 carbide particles per 100 square microns, while the razor blade made of the conventional steel contains 39 carbide particles per 100 square microns, both as counted in FIGS. 5*a* and 5*b*. The lower carbide density of the razor blade according to this invention ensures its improved rusting resistance, as corrosion is less likely to occur between carbide and steel.

The present invention is, of course, in no way restricted to the specific disclosure of the specification and drawings, but also encompasses any modifications within the scope of the appended claims.

What we claim is:

1. A process of manufacturing razor blades of high corrosion resistance, including the steps of:

annealing a strip of steel consisting of more than 0.45% and less than 0.55% by weight carbon, 0.4 to 1.0% by weight silicon, 0.5 to 1.0% weight manganese, 12 to 14% by weight chromium, and 1.0 to 1.6% by weight molybdenum, with the balance being iron and inevitable impurities, to obtain a carbide density of 100 to 150 particles per 100 square micron to provide an annealed strip of steel;

austenitizing the annealed strip of steel continuously at a temperature of 1075° to 1120° C. to provide an austenitized strip of steel;

cooling said austenitized strip of steel to a temperature between −60° to −80° C. for hardening same to provide a cooled strip of steel; and tempering said cooled strip of steel at a temperature of 250° to 400° C. to produce a tempered strip of steel having a Vickers hardeness of at least 620, wherein said tempered strip of steel has a residual austenite content that gradually decreases from a surface of said tempered strip of steel inwardly, said residual austenite content ranges from 24 to 32% at said surface of said tempered strip of steel and from 6 to 14% at a depth of 50 microns below said surface of said tempered strip of steel.

2. A process according to claim 1, wherein said carbide density of 100 to 150 particles per 100 square microns is produced by annealing in a continuous annealing process at 800° to 840° C. and a heating rate of at least. 15° C./hr.

3. A process according to claim 1, wherein said strip of steel has a carbide density of 10 to 45 particles per 100 square microns after hardening and tempering.

4. A strip of steel of high corrosion resistance for manufacturing razor blades, said steel consisting essentially of more than 0.4% and less than 0.55% by weight carbon, 0.4 to 1.0% by weight silicon, 0.5 to 1.0% by weight manganese, 12 to 14% by weight chromium, and 1.0 to 1.6% by weight molybdenum, with the balance being iron and inevitable impurities, wherein said strip of steel is annealed to obtain a carbide density of 100 to 150 particles per 100 square microns, subsequently austenitized continuously at a temperature o 1075° to 1120° C., then cooled to a temperature between −60° and −80° C. for hardening same, and tempered at a temperature of 250° to 400° C. to produce a Vickers hardness of at least 620 and a carbide density of 10 to 45 particles per 100 square microns wherein said tempered strip of steel has a residual austenite content that gradually decrease from a surface of said tempered strip of steel inwardly, said residual austenite content ranges from 24 to 32% at said surface of said tempered strip of steel and from 6 to 14% at a depth of 50 microns below said surface of said tempered strip of steel.

5. Steel of high corrosion resistance, consisting essentially of more than 0.45% and less than 0.55% by weight carbon, 0.4 to 1.0% by weight silicon, 0.5 to 1.0% by weight manganese, 12 to 14% by weight chromium, and 1.0 to 1.6% by weight molybdenum, with the balance being iron and inevitable impurities, wherein said steel is annealed to obtain a carbide density of 100 to 150 particles per 100 square microns then hardened and tempered to produce a carbide density of 10 to 45 particles per 100 square microns, wherein said tempered steel has a residual austenite content that gradually decreases from a surface of said tempered steel inwardly, said residual austenite content ranges from 24 to 32% at said surface of said tempered steel and from 6 to 14% at a depth of 50 microns below said tempered steel surfaces.

6. A steel according to claim 5, wherein said carbide density of 10 to 45 particles per 100 square microns is produced by:

a) hardening by austenitizing continuously at a temperature of 1075° to 1120° C. and cooling to a temperature between −60° and −80° C., and b) by tempering at a temperature of 250° to 400° C.

7. Steel as set forth in claim 5, consisting essentially of more than 0.48% and less than 0.52% by weight carbon, 0.45 to 0.60% by weight silicon, 0.7 to 0.85% by weight manganese, 13 to 14% by weight chromium, and 1.15 to 1.45% by weight molybdenum.

* * * * *